US008752400B2

(12) United States Patent
Lee et al.

(10) Patent No.: US 8,752,400 B2
(45) Date of Patent: Jun. 17, 2014

(54) REFRIGERATOR

(75) Inventors: Jee Hoon Lee, Goyang-si (KR); Sang Gyu Jung, Gwangju-si (KR); Seung Yong Yang, Gwangju-si (KR); Jae Sek Oh, Gwangju (KR); Kae Hum Lee, Gwangju (KR); Sung Cheul Park, Gwangju (KR); Jong Nam Lee, Suwon-si (KR); Ho June Jeon, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 364 days.

(21) Appl. No.: 13/243,009

(22) Filed: Sep. 23, 2011

(65) Prior Publication Data

US 2012/0073317 A1 Mar. 29, 2012

(30) Foreign Application Priority Data

Sep. 29, 2010 (KR) ..... 10-2010-0094280

(51) Int. Cl.
*F25D 19/00* (2006.01)

(52) U.S. Cl.
USPC ..... 62/449; 62/115; 62/228.1

(58) Field of Classification Search
USPC ..... 62/115, 228.1, 407, 441, 448, 449; 220/592.02; 312/404, 405
See application file for complete search history.

(56) References Cited

U.S. PATENT DOCUMENTS

| | | | | |
|---|---|---|---|---|
| 2,325,371 | A * | 7/1943 | Clerc | 62/131 |
| 2,432,011 | A * | 12/1947 | Hall | 62/337 |
| 4,908,544 | A * | 3/1990 | Lau | 312/321.5 |
| 5,322,366 | A * | 6/1994 | Revlett et al. | 312/405.1 |
| 6,138,432 | A * | 10/2000 | Banicevic | 52/784.15 |
| 2009/0229298 | A1 * | 9/2009 | Allard et al. | 62/449 |

* cited by examiner

*Primary Examiner* — Melvin Jones
(74) *Attorney, Agent, or Firm* — Staas & Halsey LLP

(57) ABSTRACT

A refrigerator includes a compressor to compress refrigerant, a condenser to liquefy the refrigerant supplied from the compressor, a capillary tube to decompress and expand the refrigerant supplied from the condenser, an evaporator to vaporize the refrigerant supplied from the capillary tube, a shutoff valve installed at an inlet of the capillary tube so as to prevent the refrigerant in the condenser during stoppage of the compressor from being moved to the evaporator, and a control unit to enable the shutoff valve to be blocked together so as to prevent movement of the refrigerant from the condenser to the evaporator during stoppage of the compressor, and to enable the shutoff valve to be opened together so as to move the refrigerant from the condenser to the evaporator during starting of the compressor.

8 Claims, 16 Drawing Sheets

FIG. 8

| SHUTOFF VALVE | TEMPERATURE (℃, F/R) | CYCLE TIME (min.) | OPERATION FACTOR (%) | ELECTRIC POWER CONSUMPTION PER MONTH (kWhr/month) | NOTE |
|---|---|---|---|---|---|
| Open | -15.9 / 6.0 | 76 | 29.9 | 52.1 | |
| On-off Control | -16.3 / 6.0 | 72.3 | 58.5 | 49.9 | Energy saving 4.2% |

REFRIGERATOR

CROSS-REFERENCE TO RELATED APPLICATIONS

This application claims the priority benefit of Korean Patent Application No. P2010-94280 filed on Sep. 29, 2010 in the Korean Intellectual Property Office, the disclosure of which is incorporated herein by reference.

BACKGROUND

1. Field

Embodiments relate to a refrigerator including a door to open and close a storage chamber provided in a main body.

2. Description of the Related Art

In general, a refrigerator includes components of a refrigeration cycle therein. The refrigerator is an apparatus to preserve storage items thereof in a frozen or refrigerated state by cold air generated through an evaporator during the refrigeration cycle.

Such a refrigerator includes a main body provided with a storage chamber for storage items such as food, and a door to open and close the storage chamber. The door is rotatably mounted, at one side end thereof, at one side of the main body to open and close the storage chamber while rotating in left and right directions.

In recent years, various kinds of refrigerators have been developed. For example, there is a refrigerator equipped with an auxiliary door to open and close an open portion provided at the door so as to take out storage items within the storage chamber without opening the door.

SUMMARY

Therefore, it is an aspect of the present embodiments to provide a refrigerator achieving reduction in energy loss caused by repeated On-Off operations of a compressor during implementation of a refrigeration cycle.

It is another aspect of the present embodiments to provide a refrigerator having an improved assembly structure between chassis coupled at upper and lower surfaces of a door and chassis coupled at opposite side surfaces of the door in the refrigerator.

It is another aspect of the present embodiments to provide a refrigerator capable of preventing a concentration of air within a door during application of a foam solution by further forming air exhaust holes at a dyke forming portion of the door, in addition to a gasket mounting portion of the door in the refrigerator.

It is a further aspect of the present embodiments to provide a refrigerator capable of eliminating an additional tape sealing finishing process by forming a structure to prevent leakage of a foam solution in a door cap.

Additional aspects of the embodiments will be set forth in part in the description which follows and, in part, will be obvious from the description, or may be learned by practice of the embodiments.

In accordance with one aspect of the present embodiments, a refrigerator includes a compressor to compress refrigerant, a condenser to liquefy the refrigerant supplied from the compressor, a capillary tube to decompress and expand the refrigerant supplied from the condenser, an evaporator to vaporize the refrigerant supplied from the capillary tube, a shutoff valve installed at an inlet of the capillary tube so as to prevent the refrigerant in the condenser during stoppage of the compressor from being moved to the evaporator, and a control unit to enable the shutoff valve to be blocked together so as to prevent movement of the refrigerant from the condenser to the evaporator during stoppage of the compressor, and to enable the shutoff valve to be opened together so as to move the refrigerant from the condenser to the evaporator during starting of the compressor.

The capillary tube, through which high-temperature high-pressure liquid refrigerant to be moved from the condenser to the evaporator passes, and a suction tube, through which low-temperature low-pressure gas refrigerant to be moved from the evaporator to the compressor passes, may be connected so that a suction line heat exchanger is configured to enable the capillary tube and the suction tube to exchange heat.

The compressor may start by a differential pressure start pattern which is activated in a state in which pressure equilibrium between a high-pressure side and the low-pressure side is not accomplished.

In accordance with another aspect of the present embodiments, a refrigerator includes a main body provided with a storage chamber, a door to open and close the storage chamber, and dykes protruding from both ends of an inside surface of the door while having a partition wall shape, wherein air exhaust holes are formed at a gasket mounting portion of a door panel to form the door and the dykes.

Edge caps may be formed at a first upper surface frame which defines an outer case of the main body.

The air exhaust holes may be formed at a dyke forming portion of the door panel.

The door may be coupled, at upper, lower, and opposite side surfaces thereof, with upper, lower, and side surface chassis, respectively.

When the upper surface chassis is assembled with the side surface chassis, the respective side surface chassis may be bent toward the upper surface chassis at edges of the door so as to be assembled with the upper surface chassis at the upper surface of the door.

When the upper surface chassis is assembled with the side surface chassis, the upper surface chassis may be bent toward the side surface chassis at the edges of the door so as to be assembled with the side surface chassis at the opposite side surfaces of the door.

When the lower surface chassis is assembled with the side surface chassis, the respective side surface chassis may be bent toward the lower surface chassis at the edges of the door so as to be assembled with the lower surface chassis at the lower surface of the door.

When the lower surface chassis is assembled with the side surface chassis, the lower surface chassis may be bent toward the side surface chassis at the edges of the door so as to be assembled with the side surface chassis at the opposite side surfaces of the door.

In accordance with further aspect of the present embodiments, a refrigerator includes a main body provided with a storage chamber, a door to open and close the storage chamber, and dykes protruding from both ends of an inside surface of the door while having a partition wall shape, wherein the door is provided, at upper and lower surfaces thereof, with a door cap, and the door cap is formed with air exhaust holes and an air trap.

The air trap may be filled with a foam solution leaked during a foam process, and air may be discharged to the outside through the air exhaust holes.

BRIEF DESCRIPTION OF THE DRAWINGS

These and/or other aspects of the invention will become apparent and more readily appreciated from the following description of the embodiments, taken in conjunction with the accompanying drawings of which:

FIG. 8 is a table illustrating experimental results when the shutoff valve is controlled and not controlled by the control unit during stoppage of the compressor according to the exemplary embodiment;

DETAILED DESCRIPTION

Figure 1:
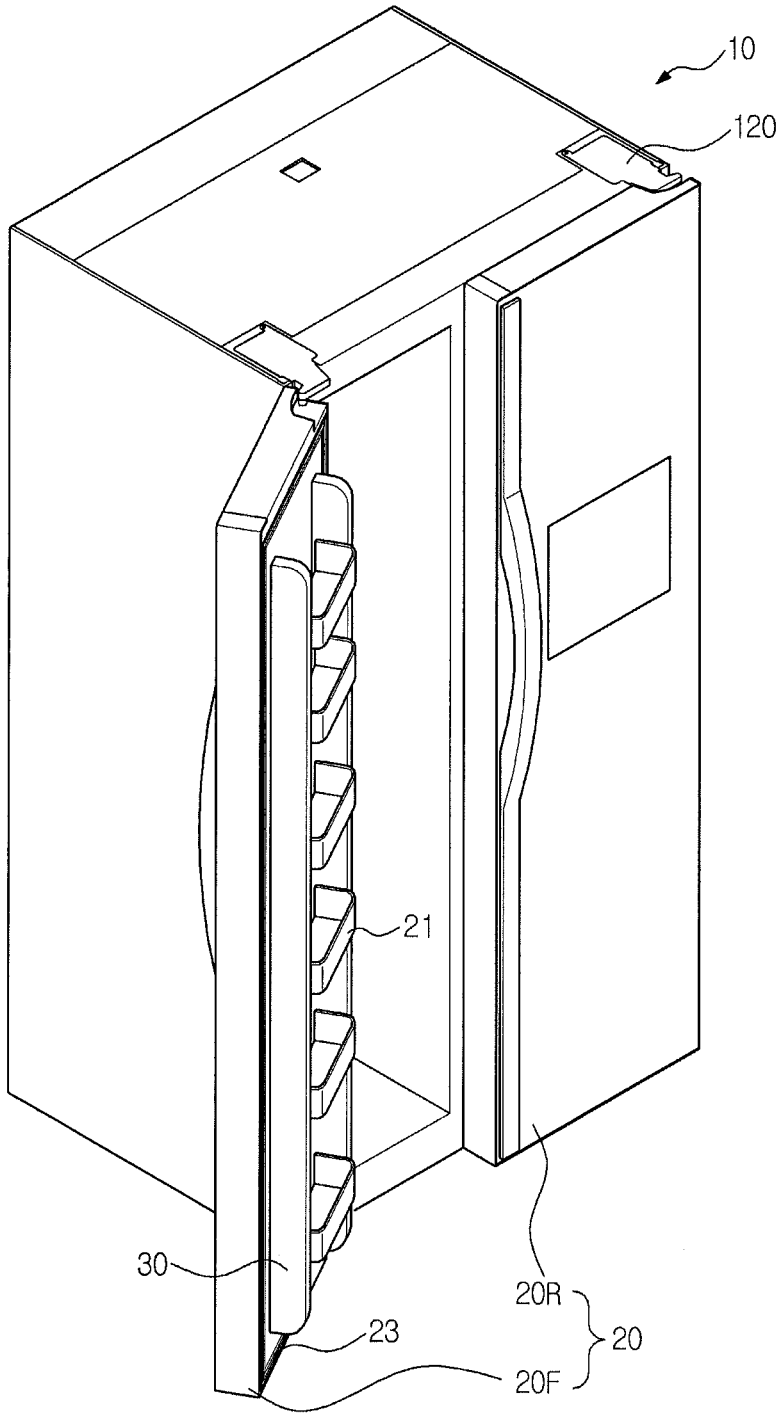
FIG. 1 is a perspective view illustrating a refrigerator according to an exemplary embodiment.

Reference will now be made in detail to the embodiments of the present invention, examples of which are illustrated in the accompanying drawings, wherein like reference numerals refer to like elements throughout.

Figure 2:
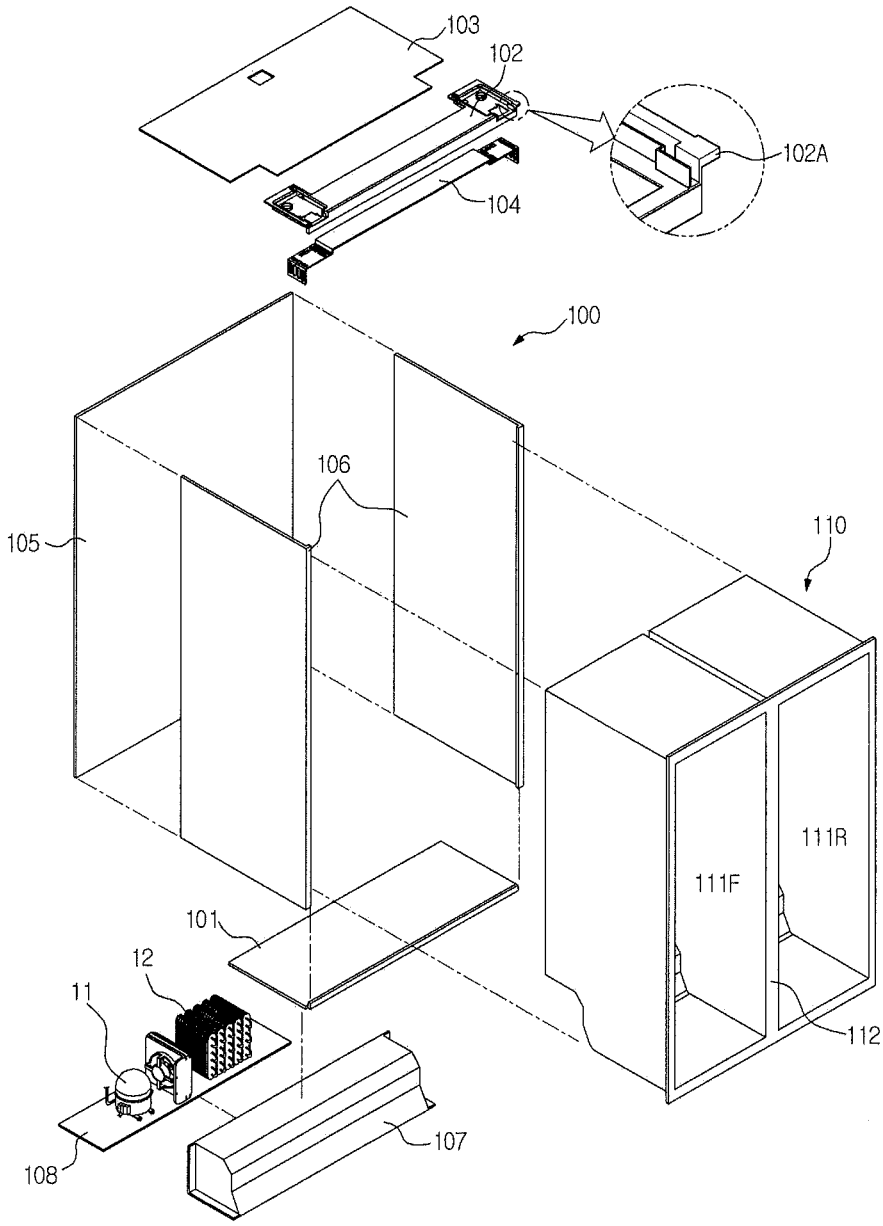
FIG. 2 is an exploded perspective view illustrating the refrigerator according to the exemplary embodiment.

As shown in FIGS. 1 and 2, a refrigerator according to an exemplary embodiment includes a main body 10 provided with storage chambers 111F and 111R to store storage items therein while defining an external appearance of the refrigerator, a door 20 rotatably mounted, at one side end thereof, at the main body 10 to open and close each of the storage chambers 111F and 111R, and dykes 30 protruding from both ends of an inside surface of the door 20 while having a partition wall shape so as to assemble and connect guards 21 formed at the inside surface of the door 20.

Figure 3:
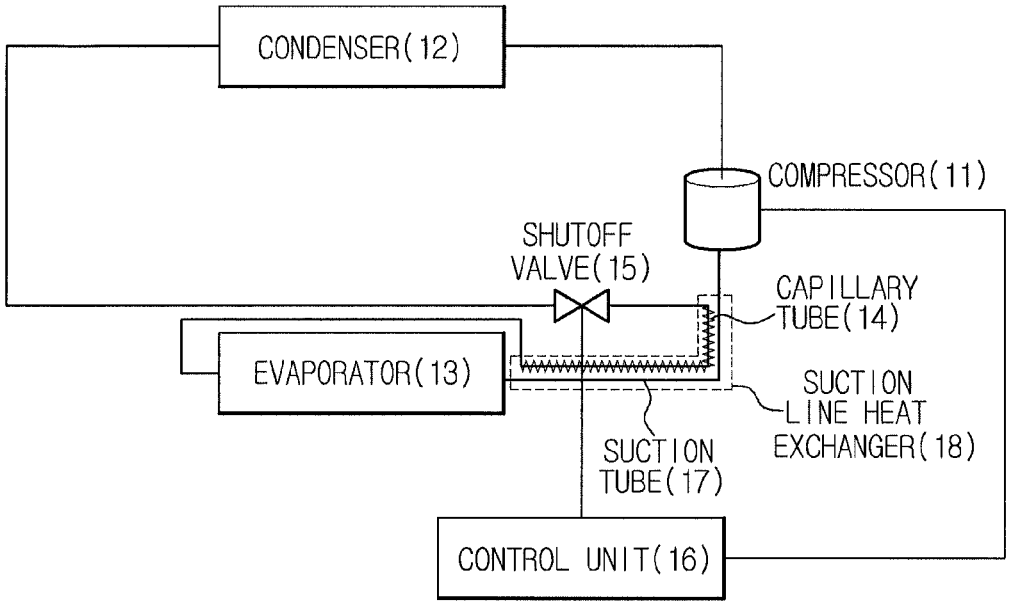
FIG. 3 is a block diagram illustrating components of a refrigeration cycle according to the exemplary embodiment.

As shown in FIGS. 2 and 3, the main body 10 includes components used in a refrigeration cycle, such as a compressor 11 to compress refrigerant, a condenser 12 to allow the refrigerant to be cooled while exchanging heat with outside air of the main body, a capillary tube 14 to decompress and expand the refrigerant, and an evaporator 13 to generate cold air through absorption of heat from air within the storage chambers 111F and 111R during evaporation of the refrigerant. In accordance with such a configuration, the cold air generated in the evaporator 13 is supplied to the storage chambers 111F and 111R, so that storage items within the storage chambers 111F and 111R may be maintained at a low temperature.

As shown in FIG. 3, the refrigeration cycle undergoes an evaporation-compression-condensation-expansion process so that refrigerant is circulated while alternately repeating phase changes from liquid to vapor and vice versa.

Looking into the evaporation-compression-condensation-expansion process of the refrigerant, liquid refrigerant within the evaporator 13 is vaporized into gas refrigerant through absorption of heat required for evaporation from air within the refrigerator, and the air within the refrigerator is cooled by loss of heat to achieve a drop in temperature. Consequently, the air within the refrigerator, in which the temperature is dropped, spreads all over the refrigerator through natural convection or by a fan (not shown), thereby keeping the temperature of the storage chambers 111F and 111R at a low temperature.

The gas refrigerant vaporized in the evaporator 13 flows into the compressor 11 through a suction tube 17 so that the liquid refrigerant may be smoothly evaporated in succession by keeping refrigerant pressure within the evaporator 13 low even when the temperature of the storage chambers 111F and 111R is low.

The gas refrigerant flowing into the compressor 11 is compressed in the compressor 11, thereby becoming an easily liquefiable state by raised pressure. That is, compressor 11 compresses the gas refrigerant into liquefied refrigerant by exerting pressure on the refrigerant.

High-temperature high-pressure gas refrigerant passing through the compressor 11 is moved to the condenser 12 in the easily liquefiable state, and then emits heat into the room temperature cooling water or air to be liquefied into the liquid refrigerant in the condenser 12

The liquid refrigerant liquefied in the condenser 12 is expanded in the capillary tube 14 to become low-temperature low-pressure liquid refrigerant which is an evaporable state, and is then moved to the evaporator 13.

The capillary tube 14, through which high-temperature high-pressure liquid refrigerant to be moved from the condenser 12 to evaporator 13 passes, and the suction tube 17, through which low-temperature low-pressure gas refrigerant to be moved from the evaporator 13 to the compressor 11 passes, are connected so that a suction line heat exchanger 18 is configured to enable the capillary tube 14 and the suction tube 17 to exchange heat, thereby improving refrigeration effects.

Through the process of the refrigeration cycle as described above, refrigerant is circulated in the refrigerator so as to transfer heat from the low-temperature storage chamber 111F and 111R to high-temperature cooling water or air, and thus the temperature of the storage chamber 111F and 111R may be maintained at a low temperature.

If the compressor 11 which is a part among the components of the refrigeration cycle repeats On-Off operation, energy loss may be generated.

In the case of a freezing chamber 111F, the high-temperature high-pressure refrigerant in the condenser 12 is moved to the evaporator 13 when the compressor 11 stops. In this case, a refrigerant temperature in the freezing chamber 111F becomes higher than the temperature of the freezing chamber 111F, as shown in FIG. 4, thereby raising an evaporative temperature.

Figure 4:
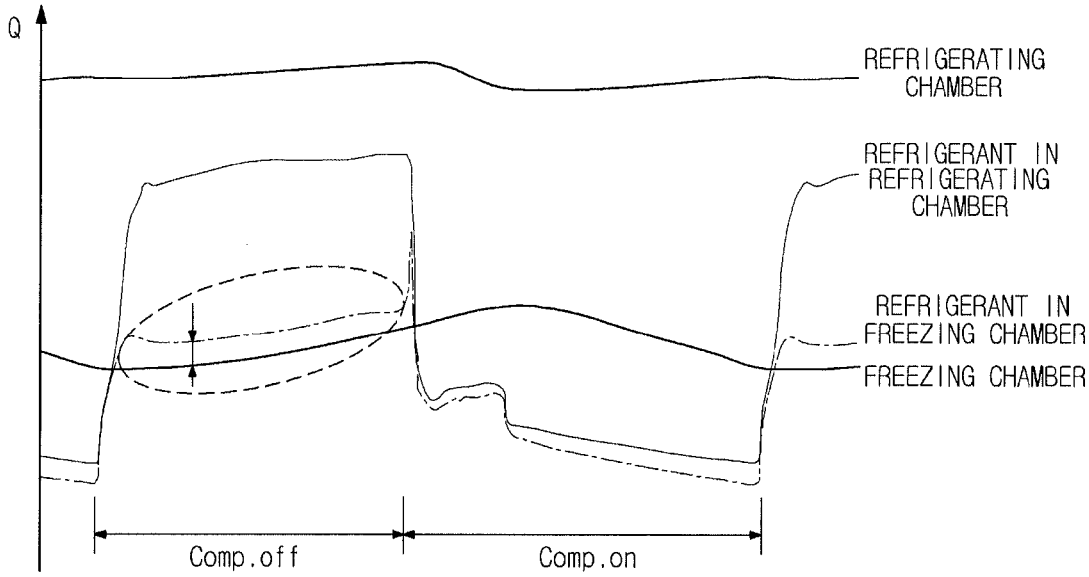
FIG. 4 is a graph illustrating loss by movement of refrigerant according to the exemplary embodiment.

Due to this raised evaporative temperature, thermal load is generated in proportion to the rise in evaporative temperature in the evaporator 13, as shown in a small circle of FIG. 4. Accordingly, in the evaporator 13 that a low-temperature low-pressure state is required to be maintained, energy loss by movement of the refrigerant is generated in proportion to the generation of the thermal load.

In the case of a refrigerating chamber 111R, the refrigerant moved from the condenser 12 to the evaporator 13 is used to cool the refrigerating chamber 111R during stoppage of the compressor 11. Consequently, the refrigerating chamber 111R is almost unaffected by movement of the refrigerant.

Figure 5:
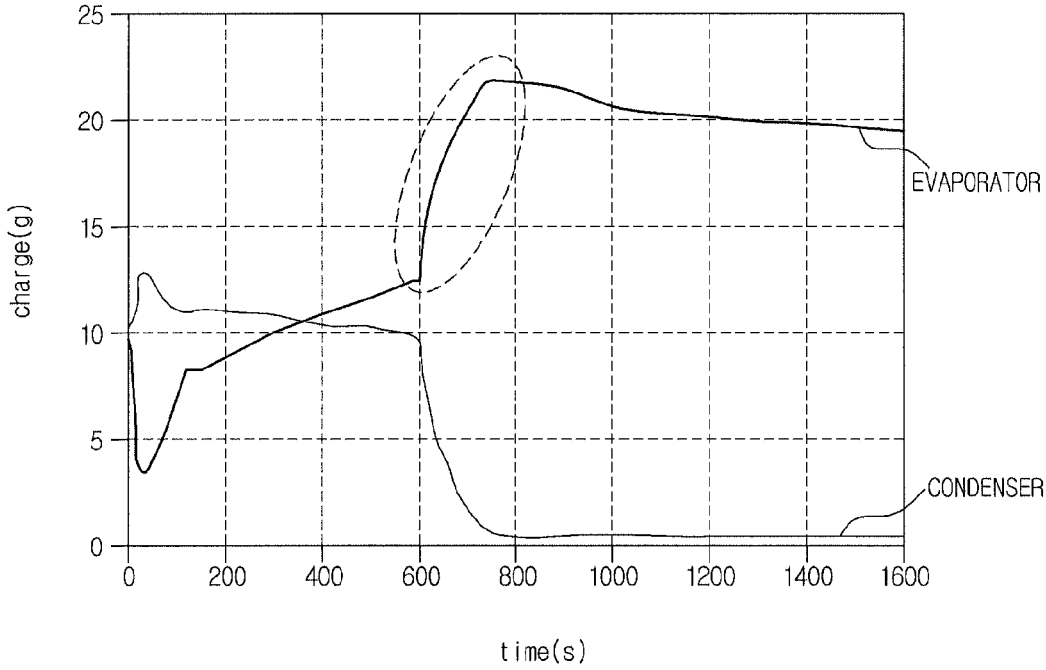
FIG. 5 is a graph illustrating loss by redistribution of refrigerant according to the exemplary embodiment.

Furthermore, when the compressor 11 stops, the refrigerant, which is compressed through compression work of the compressor 11 and is then gathered in the condenser 12, is moved to the evaporator 13 without being used to cool the storage chambers 111 and 111R, as shown in FIG. 5.

Consequently, the compression work for recompression is additionally generated in the compressor 11 in proportion to the refrigerant moved to the evaporator 13 without being used to cool the storage chambers 111F and 111R, thereby resulting in energy loss by redistribution of the refrigerant.

Therefore, to reduce generation of energy loss by movement of the refrigerant and by redistribution of the refrigerant as described above, movement of the refrigerant from the condenser 12 to the evaporator 13 during stoppage of the compressor 11 may need to be prevented.

To achieve this, a shutoff valve 15 is provided at an inlet of the capillary tube 14, as shown in FIG. 3. Thus, the shutoff valve 15 may prevent the refrigerant in the condenser 12 during stoppage of the compressor 11 from being moved to the evaporator 13.

In addition, a control unit 16 is further provided, to control the shutoff valve 15 to prevent movement of the refrigerant from the condenser 12 to the evaporator 13 during stoppage of the compressor 11.

The control unit 16 may also be linked with the compressor 11 so as to control On-Off operation of the compressor 11 together.

During stoppage of the compressor 11, the control unit 16 enables the shutoff valve 15 to be blocked so that movement of the refrigerant from the condenser 12 to the evaporator 13 may be prevented. On the other hand, during starting of the compressor 11, the control unit 16 enables the shutoff valve 15 to be opened so that the refrigerant may be moved from the condenser 12 to the evaporator 13.

Figure 6:
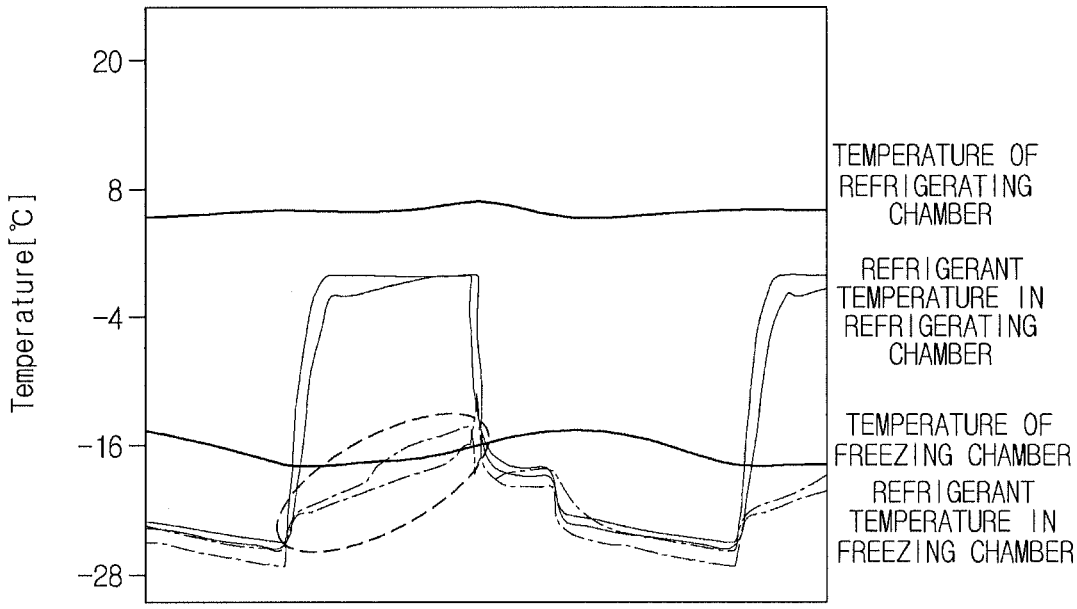
FIG. 6 is a graph illustrating an evaporative temperature when a shutoff valve is controlled by a control unit during stoppage of a compressor according to the exemplary embodiment.
Figure 7:
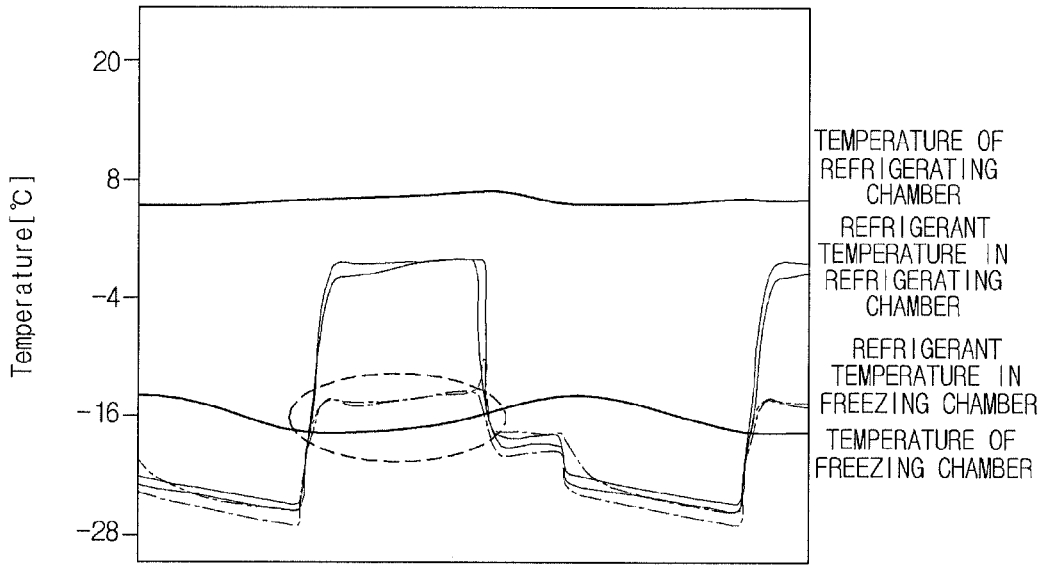
FIG. 7 is a graph illustrating an evaporative temperature when the shutoff valve is not controlled by the control unit during stoppage of the compressor according to the exemplary embodiment.

As shown in FIGS. 6 and 7, when the control unit 16 controls the shutoff valve 15 during On-Off operation of the compressor 11, the refrigerant temperature in the freezing chamber 111F may be maintained for a long time at a lower state than the temperature of the freezing chamber 111F, compared to when no control of the shutoff valve 15 is performed, thereby preventing the rise in evaporative temperature.

Furthermore, as shown in FIG. 8, when the control unit 16 controls the shutoff valve 15 during On-Off operation of the compressor 11, the refrigerant temperature in the freezing chamber may become low, and a fast cycle time and an improved operation factor of the refrigeration cycle may be achieved, compared to when no control of the shutoff valve 15 is performed. As a result, electric power consumption is reduced.

Therefore, energy saving may be accomplished in proportion to the reduction in electric power consumption, thereby efficiently operating the refrigerator.

In the refrigerator according to the exemplary embodiment, a differential pressure start pattern is applied so that the compressor 11 may be immediately reactivated also in a state in which pressure equilibrium is not accomplished when the compressor 11 stops and starts again.

Due to application of this differential pressure start pattern, a reactivation time of the compressor 11 may be shortened, thereby operating the refrigerator without energy loss.

The main body 10 is provided, at a rear lower side thereof, with a machinery chamber in which components such as the compressor 11, condenser 12, and an expansion valve (not shown) are arranged, and the storage chambers 111F and 111R are provided, at a rear side thereof, with a cooling chamber in which the evaporator 13 is arranged.

The storage chambers 111F and 111R are divided into left and right chambers so that one side and the other side of the storage chambers 111F and 111R define the freezing chamber 111F to store storage items in a frozen state and the refrigerating chamber 111R to store storage items in a refrigerated state, respectively.

The door 20 includes a freezing chamber door 20F to open and close the freezing chamber 111F, and a refrigerating chamber door 20R to open and close the refrigerating chamber 111R.

As shown in FIGS. 1 and 2, the main body 10 includes an outer case 100 to define an external appearance of the main body 10, and an inner case 110 arranged within the outer case 100 while defining the storage chambers 111F and 111R. Also, an insulating member is filled in a space between the outer and inner cases 100 and 110 through a foaming process.

The outer case 100 is mainly made of a metal material considering of durability, etc., whereas the inner case 110 is made of a resin material considering of insulating properties and convenience in manufacture.

The outer case 100 defining the external appearance of the main body 10 includes a lower surface frame 101 to define a lower surface of the outer case 100, upper surface frames 102 and 103 to define an upper surface thereof, side surface frames 106 to define opposite side surfaces thereof, a rear surface frame 105 to define a rear surface thereof, a machinery chamber cover 107 arranged a rear lower side thereof so as to define the machinery chamber, a machinery chamber frame 108 to define a lower surface of the machinery chamber, and the like.

The upper surface frames 102 and 103 are comprised of a first upper surface frame 102 coupled at opposite sides thereof to upper hinges 20 to define a front side of the upper surface of the outer case 100, and a second upper surface frame 103 arranged at a rear side of the first upper surface frame 102 to define a rear side of the upper surface of the outer case 100. Accordingly, the first and second upper surface frames 102 and 103 define the upper surface of the outer case 100, namely, the upper surface of the main body 10.

As shown in FIG. 2, the first upper surface frame 102 is provided, at opposite edges of the front side thereof, with edge caps 102A.

The edge caps 102A are integrally formed at the first upper surface frame 102 so as to be respectively fitted to the side surface frames 106 when the first upper surface frame 102 is coupled to the side surface frames 106.

The edge caps 102A are not limited to the above-described configuration, but may be separately formed. That is, the edge caps 102A, which are separately formed, may be respectively fitted to the opposite edges formed during coupling between the first upper surface frame 102 and the side surface frames 106, after the first upper surface frame 102 and the side surface frames 106 are coupled to each other.

Each of these edge caps 102A serves to prevent sharp edges from being exposed to the outside so that a user does not suffer an injury due to the sharp edges.

The first upper surface frame 102 is made of a resin material which is easily formed so as to facilitate coupling with the upper hinges 120, whereas the second upper surface frame 103 is made of a metal material to have sufficient stiffness.

The first upper surface frame 102 made of a resin material may be provided, at a lower side thereof, with a reinforcement frame 104 made of a metal material, to reinforce the first upper surface frame 102.

The inner case 110 is opened at a front side thereof to define the storage chambers 111F and 111R while being made of a resin material. The storage chambers 111F and 111R are divided into the left and right chambers by a partition wall 112 provided at the middle of the storage chambers 111F and 111R so that one side and the other side of the storage chambers 111F and 111R define the freezing chamber 111F and the refrigerating chamber 111R, respectively.

Figure 9:
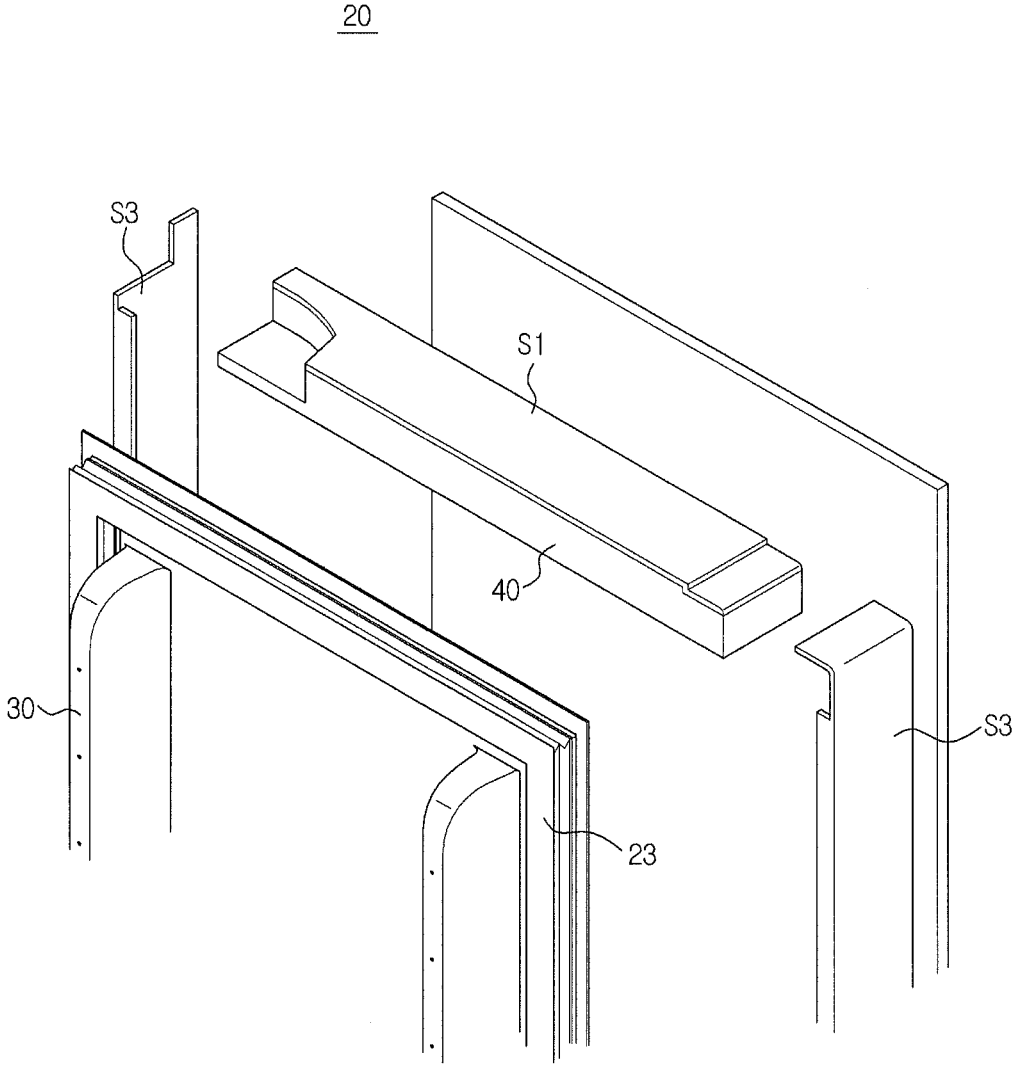
FIG. 9 is an exploded perspective view illustrating a door of the refrigerator according to the exemplary embodiment.

As shown in FIGS. 1 and 9, the door 20 is rotatably mounted at the main body 10 to open and close each of the storage chambers 111F and 111R through rotation of the door 20.

The door 20 includes the freezing chamber door 20F and the refrigerating chamber door 20R. For the freezing and refrigerating chamber doors 20F and 20R to be rotatably mounted at the main body, the main body 10 is provided, at opposite sides of an upper portion thereof, with the upper hinges 120 while being provided, at opposite sides of a lower portion thereof, with lower hinges (not shown). Each of the upper hinges 120 serves to allow an upper end of one side of each freezing or refrigerating chamber door 20F or 20R to be rotatably mounted at the upper portion of the main body 10, whereas each of the lower hinges serves to allow a lower end of one side of each freezing or refrigerating chamber door 20F or 20R to be rotatably mounted at the lower portion of the main body 10.

As shown in FIG. 1, the guards 21 are provided at the inside surface of the door 20 to store drink containers, etc.

Each guard 21 has a box shape opened at an upper surface thereof. A plurality of guards 21 is arranged at many points of the inside surface of the door 20 in upward and downward directions.

As shown in FIGS. 1 and 9, the dykes 30 protrude from both ends of the inside surface of the door 20 while having a partition wall shape to assemble guards 21 formed at the inside surface of the door 20.

Furthermore, the door 20 is provided, at the inside surface thereof, with a gasket 23 so that cold air of each storage chamber 111F or 111R is leaked to the outside through sealing of the door 20 and main body 10.

The gasket 23 may have the same rectangular shape as a border shape of the inside surface of the door 20 so as to be joined to the border of the inside surface of the door 20, and be made of a rubber material with elasticity.

As shown in FIGS. 9 to 13, the door 20 is coupled, at the upper surface, lower surface, and opposite side surfaces thereof, with chassis S.

An upper surface chassis S1 and a lower surface chassis S2, which are respectively coupled to the upper and lower surfaces of the door 20, are connected and assembled with side surface chassis S3 coupled to the opposite side surfaces of the door 20 at edge portions of the door 20. In this case, since sharp portions of the chassis S are exposed to the outside, this may inflict an injury on a user and also look aesthetically unpleasant.

Figure 10:
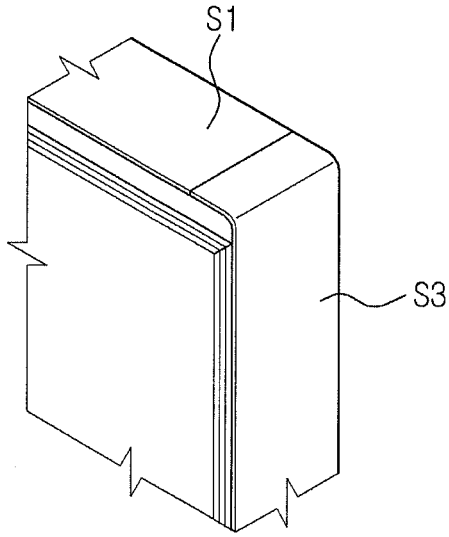
FIG. 10 is a view illustrating a structure in which upper and side surface chassis of the door in the refrigerator according to the exemplary embodiment are assembled at an upper surface of the door.

As shown in FIG. 10, when the upper surface chassis S1 of the door 20 is connected and assembled with the side surface chassis S3, the respective side surface chassis S3 are bent toward the upper surface chassis S1 at the edge portions of the door 20 and lead to the upper surface of the door 20 so that the sharp portions of the chassis S are not exposed to the outside. Consequently, the side surface chassis S3 may be assembled with the upper surface chassis S1 at the upper surface of the door 20.

Figure 11:
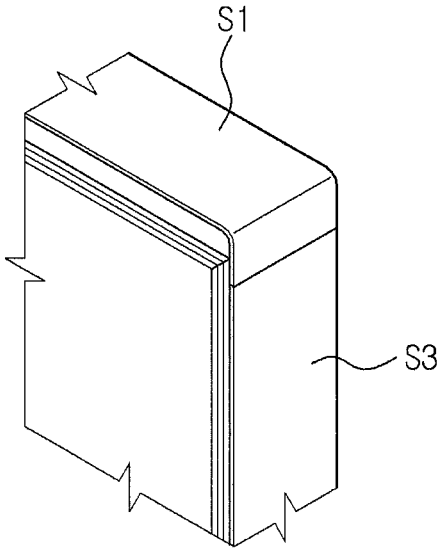
FIG. 11 is a view illustrating a structure in which the upper and side surface chassis of the door in the refrigerator according to the exemplary embodiment are assembled at a side surface of the door.

As shown in FIG. 11, when the upper surface chassis S1 of the door 20 is connected and assembled with the side surface chassis S3, the upper surface chassis S1 is bent toward the side surface chassis S3 at the edge portions of the door 20 and leads to the opposite side surfaces of the door 20. Consequently, the upper surface chassis S1 may be assembled with the side surface chassis S3 at the opposite side surfaces of the door 20.

Figure 12:
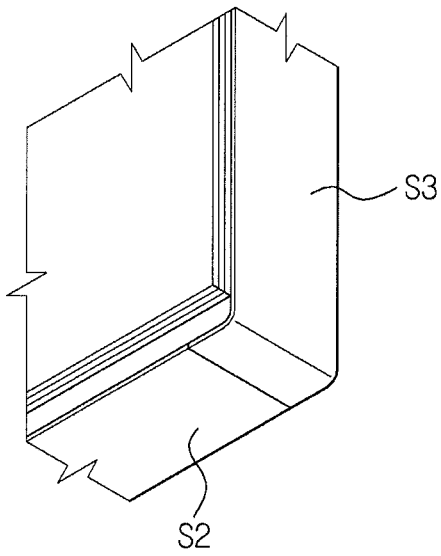
FIG. 12 is a view illustrating a structure in which lower and side surface chassis of the door in the refrigerator according to the exemplary embodiment are assembled at a lower surface of the door.

As shown in FIG. 12, when the lower surface chassis S2 of the door 20 is connected and assembled with the side surface chassis S3, the respective side surface chassis S3 are bent toward the lower surface chassis S2 at the edge portions of the door 20 and lead to the lower surface of the door 20. Consequently, the side surface chassis S3 may be assembled with the lower surface chassis S2 at the lower surface of the door 20.

Figure 13:
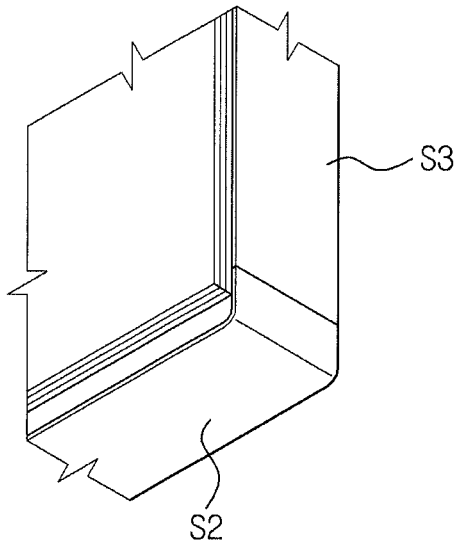
FIG. 13 is a view illustrating a structure in which the lower and side surface chassis of the door in the refrigerator according to the exemplary embodiment are assembled at the side surface of the door.

As shown in FIG. 13, when the lower surface chassis S2 of the door 20 is connected and assembled with the side surface chassis S3, the lower surface chassis S2 is bent toward the side surface chassis S3 at the edge portions of the door 20 and leads to the opposite side surfaces of the door 20. Consequently, the lower surface chassis S2 may be assembled with the side surface chassis S3 at the opposite side surfaces of the door 20.

As described above, when the upper and lower surface chassis S1 and S2 are assembled with the side surface chassis S3, the chassis S are bent at the edge portions of the door 20. Accordingly, since the chassis S are assembled at the upper and lower surfaces or opposite side surfaces of the door 20, not at the edge portions of the door 20, the sharp portions of the chassis S are not exposed to the outside.

In an embodiment, each edge portion of the door 20 has a round shape so as to achieve safe use of the door by a user and an improved aesthetically pleasing external appearance.

Figure 14:
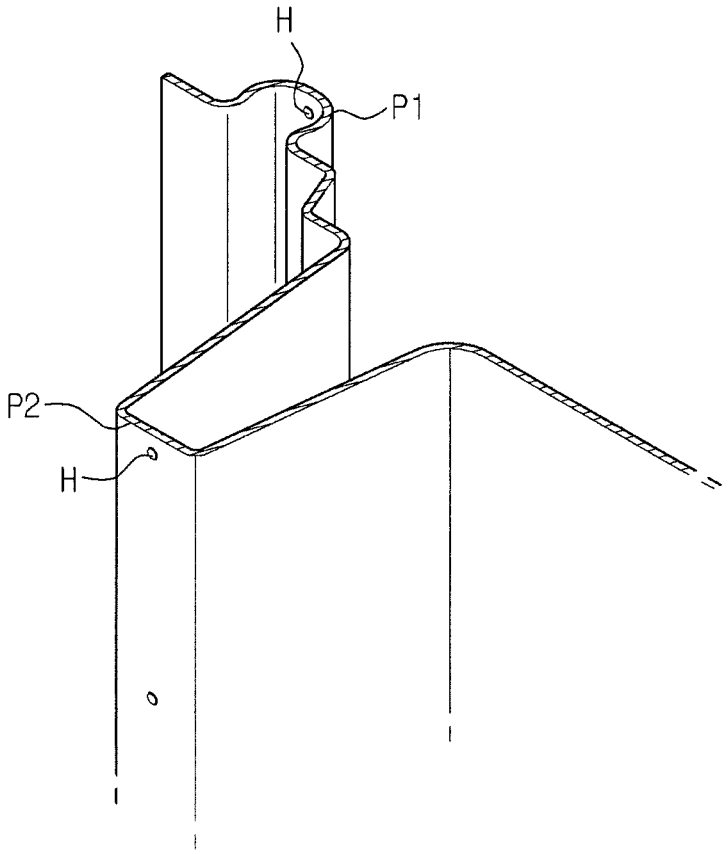
FIG. 14 is a perspective view illustrating a structure in which air exhaust holes are formed at a door panel according to the exemplary embodiment.

As shown in FIG. 14, a foam solution is applied to a door panel P having an outer shape of the door 20, thereby forming the door 20.

The door panel P includes a gasket mounting portion P1, a dyke forming portion P2, and the like.

The gasket mounting portion P1 of the door panel P is formed with air exhaust holes H to discharge air generated when the foam solution is applied.

Since the foam solution is lastly filled in the dyke forming portion P2 of the door panel P when the foam solution is applied to the door panel P, a concentrated phenomenon of air is generated.

Thus, air is concentrated on the dyke forming portion P2 of the door panel P, thereby resulting in problems such as a fault of the dyke forming portion P2. to this, another air exhaust holes H may also be formed at to dyke forming portion P2.

As shown in FIG. 9, the door 20 is provided, at the upper surface thereof, with a door cap 40.

Although not shown, the door cap 40 may also be provided at the lower surface of the door 20.

Figure 15:
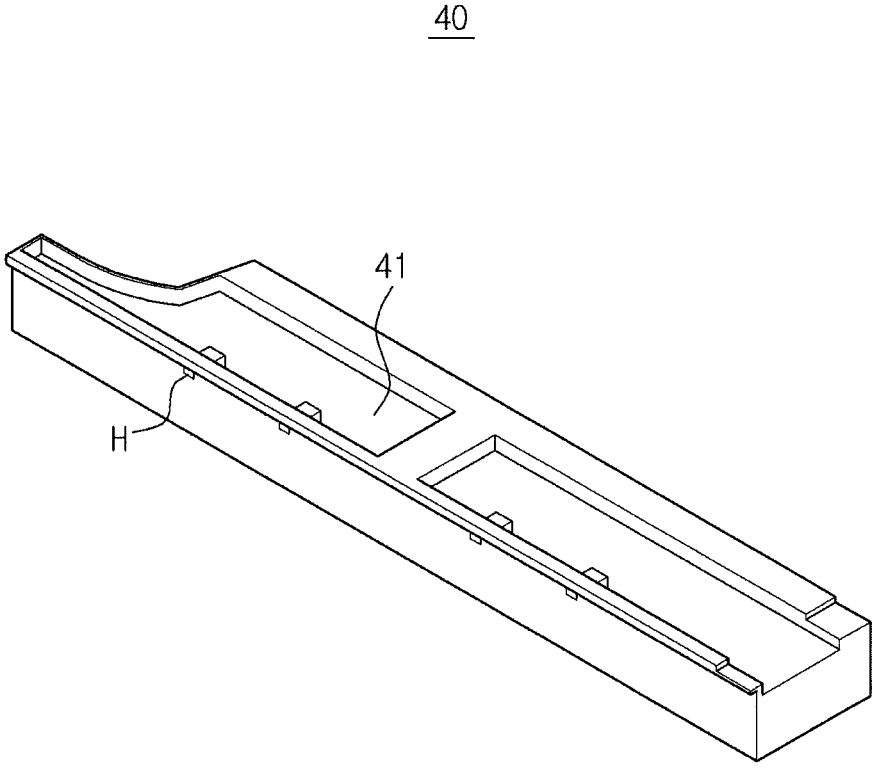
FIG. 15 is a perspective view illustrating a door cap of the refrigerator according to the exemplary embodiment.
Figure 16:
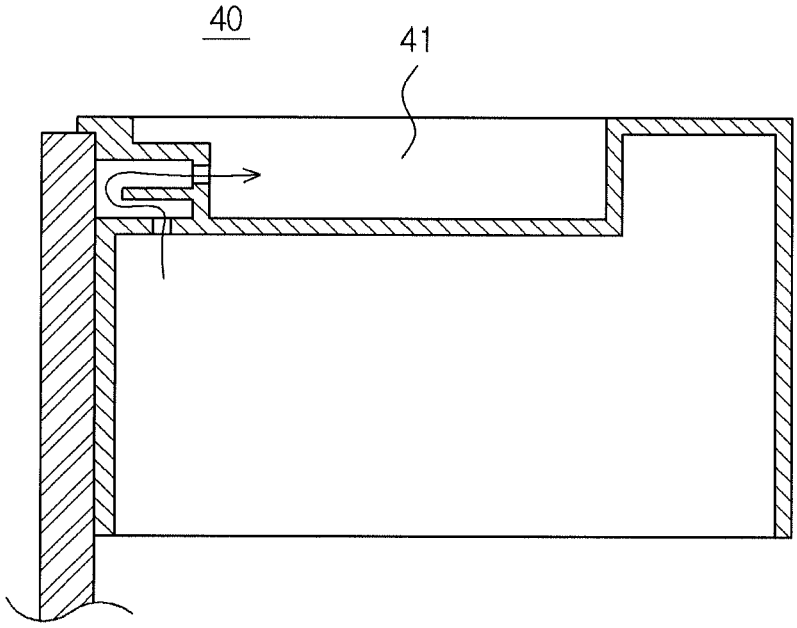
FIG. 16 is a sectional view illustrating the door cap of the refrigerator according to the exemplary embodiment.

As shown in FIGS. 15 and 16, the door cap 40 is formed with air exhaust holes H to discharge air generated during application of the foam solution.

The foam solution as well as air is leaked to the outside through the air exhaust holes H formed to discharge air generated during application of the foam solution, thereby resulting in problems.

When the foam solution is leaked to the outside, problems such as a fault of the external appearance may be generated.

The door cap 40 further includes an air trap 41 to prevent the foam solution from being leaked to the outside.

The air trap 41 is formed on a path to allow air to be discharged into the air exhaust holes H.

Due to formation of the air trap 41 in the door cap 40, the foam solution is moved to the air exhaust holes H along an arrow direction shown in FIG. 16 together with air, and is then filled in the air trap 41. In this case, the air is moved to the air exhaust holes H, and is then discharged to the outside.

In accordance with the configuration of such an air trap 41, only air generated during application of the foam solution may be surely discharged to the outside. In addition, an additional tape sealing finishing process is not required, thereby achieving reduction in production cost and improved assembly ability.

As is apparent from the above description, energy loss caused by repeated On-Off operations of the compressor may be reduced by further including a shutoff valve in components of a refrigeration cycle so as to implement a differential pressure start pattern.

Also, when the chassis coupled at the upper and lower surfaces of the door are assembled with the chassis coupled at the opposite side surfaces of the door, the assembly of the chassis is performed at the upper and lower surfaces or opposite side surfaces of the door, not at the edge portions of the door, thereby achieving safety of a user and an improved aesthetically pleasing external appearance.

In addition, the dyke forming portion of the door panel is formed with the air exhaust holes, thereby preventing a concentration of air.

Furthermore, the door cap is formed with the air trap, thereby preventing the foam solution from being leaked to the outside and eliminating an additional tape sealing finishing process.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body including a storage chamber;

a door to open and close the storage chamber; and dykes protruding from both ends of an inside surface of the door while having a partition wall shape, wherein air exhaust holes are formed at a gasket mounting portion of a door panel to form the door and the dykes.

2. The refrigerator according to claim 1, wherein edge caps are formed at a first upper surface frame which defines an outer case of the main body.

3. The refrigerator according to claim 1, wherein the air exhaust holes are formed at a dyke forming portion of the door panel.

4. The refrigerator according to claim 1, wherein:

the door is coupled, at upper, lower, and opposite side surfaces thereof, with upper, lower, and side surface chassis, respectively; and when the upper surface chassis is assembled with the side surface chassis, the respective side surface chassis are bent toward the upper surface chassis at edges of the door so as to be assembled with the upper surface chassis at the upper surface of the door.

5. The refrigerator according to claim 4, wherein when the upper surface chassis is assembled with the side surface chassis, the upper surface chassis is bent toward the side surface chassis at the edges of the door so as to be assembled with the side surface chassis at the opposite side surfaces of the door.

6. The refrigerator according to claim 4, wherein when the lower surface chassis is assembled with the side surface chassis, the respective side surface chassis are bent toward the lower surface chassis at the edges of the door so as to be assembled with the lower surface chassis at the lower surface of the door.

7. The refrigerator according to claim 4, wherein when the lower surface chassis is assembled with the side surface chassis, the lower surface chassis is bent toward the side surface chassis at the edges of the door so as to be assembled with the side surface chassis at the opposite side surfaces of the door.

8. A refrigerator comprising:

a main body including a storage chamber;

a door to open and close the storage chamber; and dykes protruding from both ends of an inside surface of the door while having a partition wall shape, wherein:

the door is provided, at upper and lower surfaces thereof, with a door cap;

the door cap is formed with air exhaust holes and an air trap; and the air trap is filled with a foam solution leaked during a foam process, and air is discharged to the outside through the air exhaust holes.

* * * * *